United States Patent [19]

Penny

[11] 4,301,657

[45] Nov. 24, 1981

[54] GAS TURBINE COMBUSTION CHAMBER

[75] Inventor: Robert N. Penny, Coventry, England

[73] Assignee: Caterpillar Tractor Co., Peoria, Ill.

[21] Appl. No.: 35,595

[22] Filed: May 3, 1979

[30] Foreign Application Priority Data

May 4, 1978 [GB] United Kingdom ..... 17620/78

[51] Int. Cl.[3] ..... F02C 7/22

[52] U.S. Cl. ..... 60/748; 60/750; 60/758; 60/759

[58] Field of Search ..... 60/758, 759, 748, 750; 431/353

[56] References Cited

U.S. PATENT DOCUMENTS

| | | | |
|---|---|---|---|
| 2,510,645 | 6/1950 | McMahan | 60/758 |
| 2,601,000 | 6/1952 | Nerad | 60/758 |
| 2,807,139 | 9/1957 | Jackson | 60/758 |
| 3,099,134 | 7/1963 | Calder et al. | 60/758 |
| 3,134,229 | 5/1964 | Johnson | 60/758 |
| 3,656,297 | 4/1972 | Monk | 60/758 |
| 4,054,028 | 10/1977 | Kawaguchi | 60/758 |

FOREIGN PATENT DOCUMENTS

| | | | |
|---|---|---|---|
| 836117 | 6/1960 | United Kingdom | 60/758 |

*Primary Examiner*—Robert E. Garrett

*Attorney, Agent, or Firm*—Gifford, VanOphem, Sheridan & Sprinkle

[57] ABSTRACT

A gas turbine combustion chamber in which the primary air inlets in a peripheral wall of the combustion chamber are defined by open-ended tubes extending inwardly from the peripheral wall by a substantial distance into the combustion chamber and having their inner, that is their outlet, ends facing in an upstream direction within the combustion chamber, whereby each of the tubes will introduce a stream of air with at least a component of motion in the upstream direction along or parallel with the longitudinal axis of the combustion chamber, thereby to effect recirculation of fuel, air and combustion gases within the combustion chamber. Similar air inlet tubes may be provided for introducing secondary and tertiary air into the combustion chamber.

3 Claims, 6 Drawing Figures

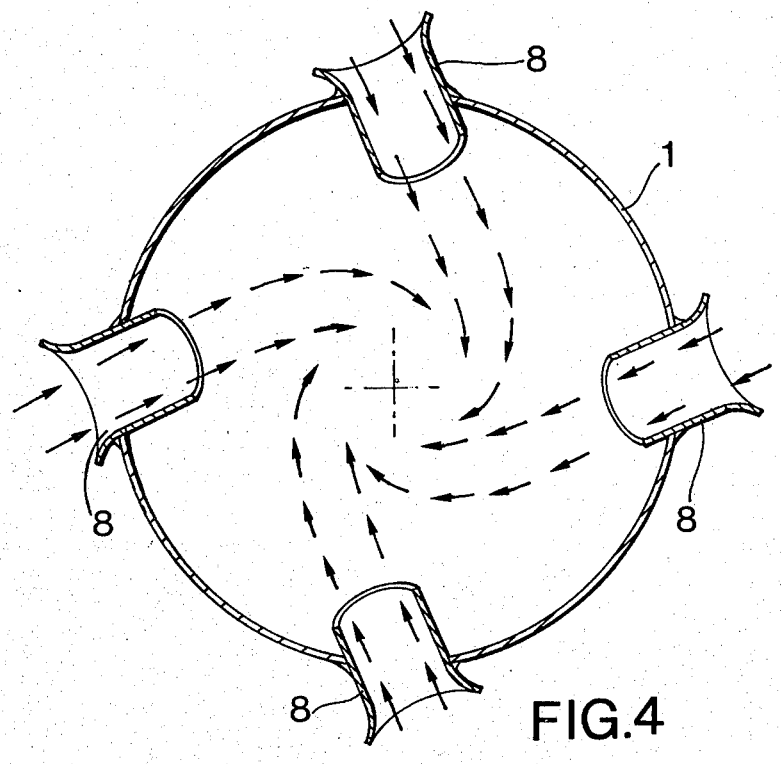
FIG.4
FIG.5
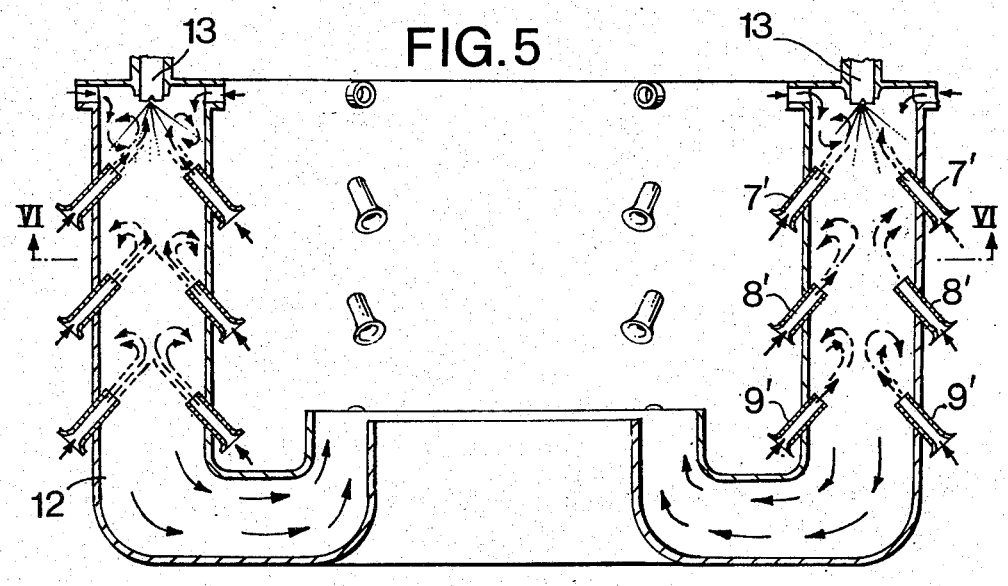

GAS TURBINE COMBUSTION CHAMBER

BACKGROUND OF THE INVENTION

The invention relates to a gas turbine combustion chamber of the type (hereinafter called the 'type described') having a peripheral wall or walls defining a cylindrical or annular combustion region, a closed head and supporting at least one fuel inlet through which, during operation, a liquid, vaporised or gaseous fuel is introduced into the combustion region, air inlets in or adjacent the fuel inlet through which, during operation, air is introduced to effect swirling of the fuel, and an open downstream end from which combustion products in a condition acceptable by a turbine are ducted to the turbine or turbines.

DESCRIPTION OF THE PRIOR ART

In combustion chambers of the foregoing type which have been proposed hitherto, air holes have been provided in a peripheral wall, for example a flame-tube, of the combustion chamber for the purpose of introducing primary, secondary, and tertiary air streams. These holes usually have edges which are flat in cross-section or they may be formed by inward plunging and therefore have edges which are convex in cross-section.

The purpose of the primary air holes is to admit air in a manner which will create strong vortices to stabilise and substantially to complete combustion within a primary zone; but the effectiveness for this purpose of the types of hole described is limited by inadequate penetration and early diffusion of the air streams entering the combustion chamber through these holes, together with deflection of the air streams away from the primary zone by the moving volume of gases being generated there. This deflection may also be affected by the direction of approach of the air entering the primary holes. The result of these limitations is an insufficiently strong primary vortex and a fuel-rich primary zone, such that combustion is not substantially completed within the primary zone but, instead, continues in the cooler regions further downstream in the combustion chamber. This may result in an increase in the quantity of particulates resulting from unsatisfactory combustion, particularly with heavier fuels, for example diesel fuel as compared with kerosine.

The purpose of the secondary holes is to complete the combustion and that of the tertiary holes is to cool the products of combustion to the specified operating temperature and to achieve a substantially uniform temperature throughout the outlet area at the downstream end of the combustion chamber and thereby high reliability and life of the gas turbine components. In known combustion chambers of the foregoing kind, the holes provided for the introduction of secondary and tertiary air produce the same limitations as those described above for the primary air, that is inadequate penetration and early diffusion, together with deflection of the air streams by the moving volume of the products of combustion and, in certain configurations, also by the direction of air entering the secondary and tertiary air holes. The results of these limitations are insufficient contribution to completion of combustion by the secondary air holes before the gases reach the cooler tertiary zone and an unacceptable non-uniform variation of the temperature distribution of the gases at the outlet end of the combustion chamber due to insufficient mixing of the cooling air streams from the tertiary air holes with the products of combustion.

SUMMARY OF THE INVENTION

According to the invention, a gas turbine combustion chamber of the type described includes primary air inlets in a peripheral wall of the combustion chamber defined by open-ended tubes extending inwardly from the peripheral wall by a substantial distance into the combustion chamber and having their inner, that is their outlet, ends facing in an upstream direction within the combustion chamber, whereby each of the tubes will introduce a stream of air with at least a component of motion in the upstream direction along or parallel with the longitudinal axis of the combustion chamber, thereby to effect recirculation of fuel, air and combustion gases within the combustion chamber.

Further similar open-ended tubes may be similarly arranged in positions downstream of the primary air inlets to effect introduction of secondary and tertiary air streams. The secondary and tertiary air tubes may be so directed that their air streams are offset from a diametral plane through the combustion chamber to create rotation in the same direction as swirl air admitted at the upstream end of the combustion chamber.

The aforesaid air tubes for introducing primary, secondary and tertiary air into the combustion chamber may be cylindrical or of other cross-sectional shape as required to achieve an optimum result, and are arranged with their longitudinal axes inclined to the longitudinal centre-line of the combustion chamber by obtuse angles defined between the longitudinal axis of each air tube and the longitudinal centre-line of the combustion chamber in the upstream direction.

The air tubes may be so arranged in the combustion chamber that the streams of air issuing from the air tubes on meeting are deflected in an upstream direction substantially co-axially with the axis of the combustion chamber or of a fuel inlet.

Preferably each air tube has an inlet end, outside the combustion chamber, which is outwardly-flared. Where the air tubes are cylindrical they are preferably bell-mouthed at their inlet, that is the outer, ends.

The combustion chamber, or a flame-tube positioned within an outer housing, may be metallic and in that case would conveniently be provided with means for producing air film or other cooling. Alternatively, the combustion chamber may be made wholly of ceramic materials or partly of ceramic and partly of metallic materials.

The fuel inlet may be a nozzle for introducing a liquid fuel spray or instead another kind of fuel inlet may be provided, for introducing a vaporised or gaseous fuel.

BRIEF DESCRIPTION OF THE DRAWINGS

By way of example two alternative combustion chambers in accordance with the invention are now described with reference to the accompanying diagrammatic drawings, in which:

FIG. 4 is a cross-section on the plane IV—IV in FIG. 1 and showing an optional modified arrangement of air inlet tubes 8;

FIG. 5 is an axial cross-section through the second combustion chamber which is of the annular kind, and

DESCRIPTION OF THE PREFERRED EMBODIMENTS

Figure 6:
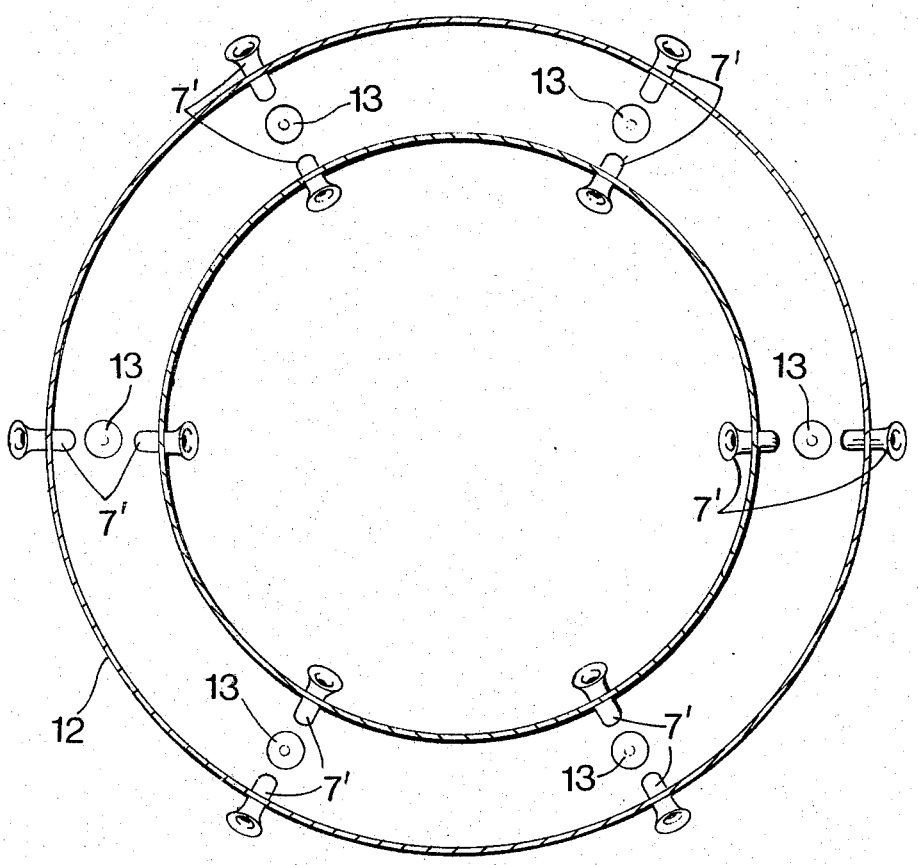

FIG. 6 is a cross-section on the plane VI—VI in FIG. 5.

Figure 1:
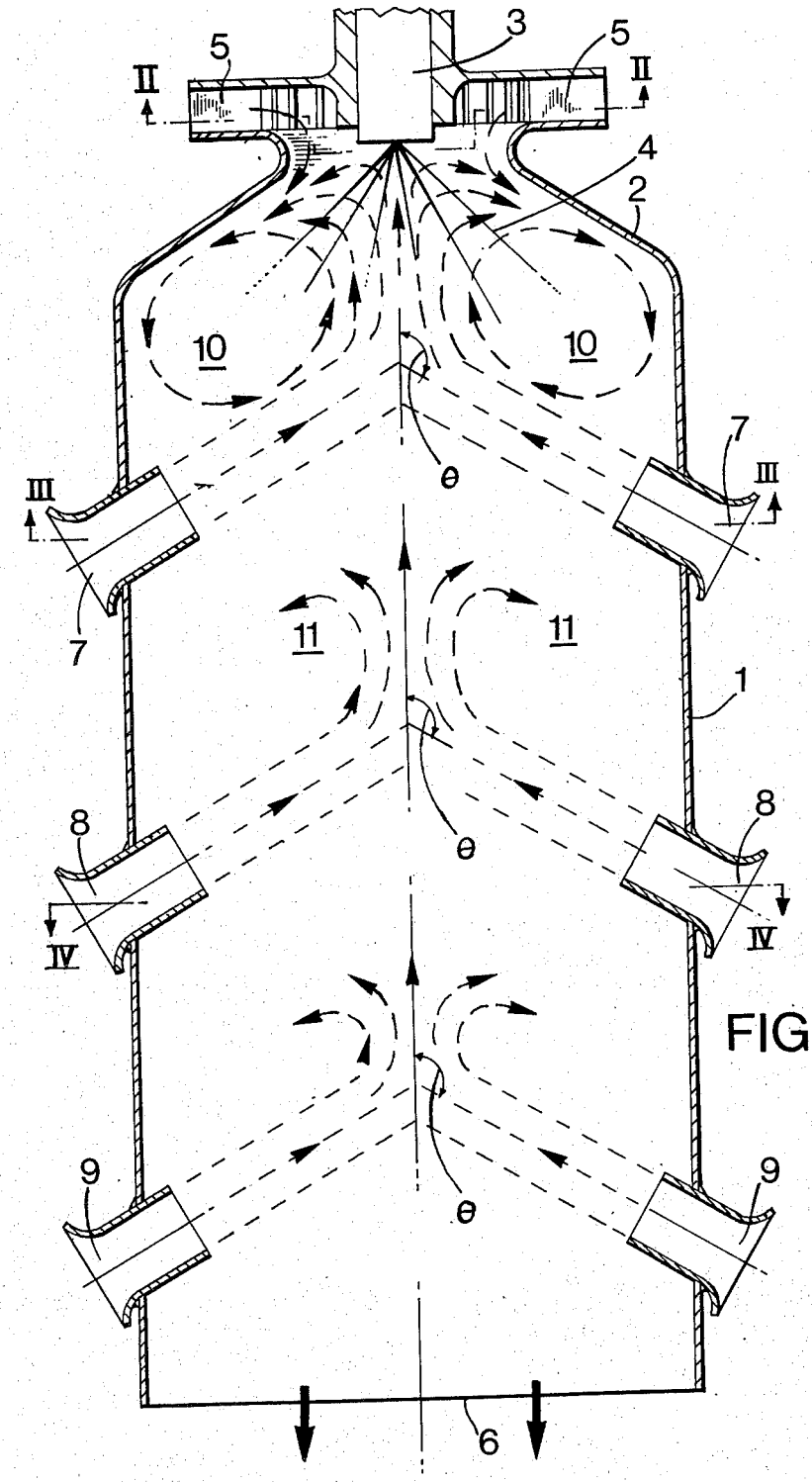
FIG. 1 is an axial cross-section through the first combustion chamber which is of the cylindrical kind.
Figure 2:
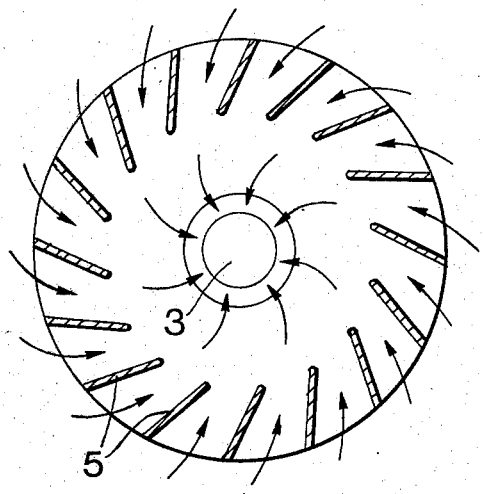
FIG. 2 is a cross-section on the plane II—II in FIG. 1.
Figure 3:
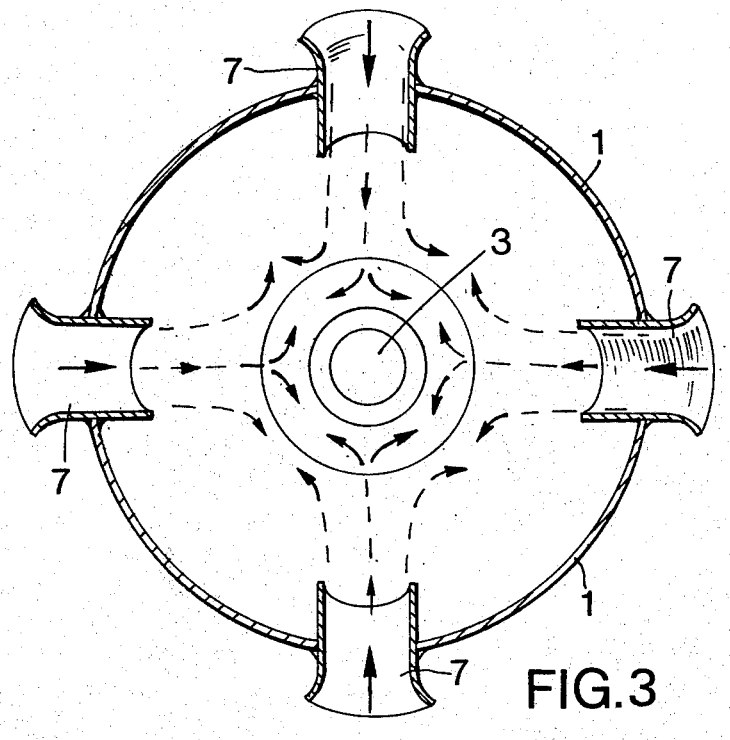
FIG. 3 is a cross-section on the plane III—III in FIG. 1.

Referring to FIGS. 1 to 3, the first combustion chamber 1 is cylindrical and has an integral upstream end wall 2 in which there is a central fuel nozzle 3 co-axial with the combustion chamber and which in operation will produce a fuel spray indicated at 4. The fuel nozzle 3 is surrounded by a ring of vanes 5 defining therebetween inlets for swirl air. In FIG. 1 only two vanes 5 have been shown at diametrically-opposite positions. The fuel envisaged is a vaporific liquid fuel e.g., kerosine or diesel fuel. The downstream end of the combustion chamber is open at 6. The direction of flow of the swirl air is indicated in FIG. 2.

In accordance with the invention, the combustion chamber has air inlets provided by cylindrical tubes 7, 8 and 9 arranged in rings around the combustion chamber axis at different positions in the axial length of the combustion chamber and providing, respectively, primary, secondary and tertiary air. Each tube 7, 8 and 9 has its inlet end, that is the end outside the combustion chamber, outwardly-flared or bell-mouthed and is open at its outlet, that is its inner end. Each tube 7, 8 and 9 extends radially (as in FIG. 3) a substantial distance into the interior of the combustion chamber and is also inclined towards the upstream end of the combustion chamber (as shown in FIG. 1). Thus the longitudinal axis of each tube 7, 8 or 9 makes an obtuse angle $\theta$ with the longitudinal centre-line of the combustion chamber and the fuel nozzle 3, in an upstream direction. The tubes of each ring tubes 7, 8, 9 may be of the same or different diameters, be arranged at different axial and circumferential spacings than those shown, be arranged at the same or different angles $\theta$ or be of different lengths or cross-sectional shapes according to the air and gas flows and other conditions to be effected. The dimensions and arrangements of the tubes 7, 8 and 9 illustrated are merely schematic and indicative of the principles involved.

The air introduced through the primary air tubes 7 is deflected in the region of the axis of the combustion chamber to effect recirculation at regions 10 of the fuel and swirl air as indicated in FIG. 1. By using tubes 7 which extend a substantial distance into the combustion chamber, the primary air streams will merge together adjacent or on the longitudinal centre-line of the fuel nozzle and combustion chamber and be mutually deflected in an upstream direction into the interior of the fuel spray 4 and carry the fuel droplets around in a strong vortex which will be created. By making the mouths of the tubes 7 outwardly-flared or belled, the direction of the air streams issuing from the tubes 7 will be substantially unaffected by the direction of the air streams entering the mouths of the tubes 7.

The tubes 8 produce secondary air streams 11 and may extend radially similarly to the tubes 7 shown in FIG. 3. Alternatively the secondary air streams 11 may be employed to effect rotation of the secondary air in the same direction as the swirl air admitted at the upstream end of the combustion chamber and which has been mixed with fuel droplets and the primary air. This is effected by offsetting the air tubes 8 from a diametral plane through the combustion chamber that is by arranging them tangentially to a notional circle concentric with the longitudinal axis of the combustion chamber 1, as shown in FIG. 4. In this arrangement the tubes 8 are still inclined in the upstream direction, as shown in FIG. 1.

The arrangement of the tubes 7 and 8 are such that the merged primary and secondary air streams are mutually deflected in an upstream direction co-axially of the combustion chamber and fuel nozzle.

The provision and arrangement of the tubes 7 and 8 effect a reduction of undesirable particulates in the products of combustion and also contribute to a more uniform temperature distribution at the outlet end 6 of the combustion chamber.

Cooling of the products of combustion to a specified engine operating temperature, and uniformity of temperature distribution over substantially the whole area at the outlet end of the combustion chamber 6 are further achieved by the introduction of tertiary air through the tubes 9 which are similar to and are arranged similarly to the tubes 8 as shown in FIGS. 1 and 3. The tubes 9 may be radial, that is they may be arranged similarly to the tubes 7 shown in FIG. 3 or they may be offset from a diametral plane through the combustion chamber to effect rotation of the tertiary air in the same direction as the swirl air at the upstream end of the combustion chamber, similarly to the tubes 8 as shown in FIG. 4.

The arrangement of the tubes 7, 8 and 9 with their longitudinal axes inclined in an upstream direction as shown in FIG. 1 increase the time the respective air streams remain in the primary, secondary and tertiary regions with consequent improvement in the completion of combustion, the reduction of particulates, and mixing of air and gases and hence uniformity in the temperature distribution at the outlet end of the combustion chamber.

Since the velocity of the combustion gases increases from the upstream to the downstream ends of the combustion chamber, the primary air streams directed towards the upstream end of the combustion chamber create a desirable air/fuel ratio, good mixing and a strong vortex there; and the secondary and tertiary air streams impinge for shorter axial distances in the upstream direction in the combustion chamber against the gases which are moving with increased velocity in the respective secondary and tertiary regions.

Although the combustion chamber shown in FIGS. 1 to 4 is of the cylindrical kind, the same principles and use of the tubes 7, 8 and 9 may be applied to an annular combustion chamber. An annular combustion chamber 12 is shown in FIGS. 5 and 6 and has a ring of fuel nozzles 13 of which two only are shown in FIG. 5 for introducing liquid, vaporised or gaseous fuel. Tubes 7', 8' and 9' are arranged similarly to the tubes 7, 8 and 9 in the cylindrical combustion chamber of FIGS. 1 to 4 whereby air streams issuing from the tubes 7', 8', 9' will effect similar air and gas circulations and the same beneficial results as those in the cylindrical combustion chamber described hereinbefore.

In the examples described at least one fuel nozzle has been provided. Alternatively another type of fuel inlet may be provided in either of the examples. For example the alternative fuel inlet may be a gaseous or vaporizing nozzle or tube.

What I claim as my invention and desire to secure by Letters Patent of the United States is:

1. A gas turbine combustion chamber of generally cylindrical shape having a peripheral wall having primary air inlets therein, a closed head, at least one fuel inlet therein and means for introducing swirl air into the combustion chamber adjacent said fuel inlet, the combustion chamber having an open downstream end and said primary inlets defined by a first set of open-ended tubes, each having an imperforate axially continuous wall extending inwardly through said peripheral wall and projecting a substantial distance from the inner periphery of said peripheral wall into the combustion chamber and having its inner, that is its outlet, end facing in an upstream direction within the combustion chamber, to introduce a discrete stream of air with at least a component of motion in the upstream direction to effect recirculation of fuel, air and combustion gases within the combustion chamber and its outer, that is its inlet, end extending outwardly of the combustion chamber, and outwardly flared, second and third sets of open-ended tubes similar to said first set and similarly arranged in positions downstream of the primary air inlets to effect respectively introduction of secondary and tertiary air streams, said secondary and tertiary air tubes so directed that their respective air streams are offset from a diametral plane through the combustion chamber to create rotation in the same direction as swirl air admitted at the upstream end of the combustion chamber, said air tubes for introducing streams of primary, secondary and tertiary air into the combustion chamber having their longitudinal axes inclined to the longitudinal centre-line of the combustion chamber by obtuse angles defined between the longitudinal axis of each air tube and the longitudinal centre-line of the combustion chamber in the upstream direction.

2. A combustion chamber as claimed in claim 1 in which said air tubes introduce streams of air which meet and are deflected in an upstream direction substantially co-axial with the axis of the combustion chamber.

3. A combustion chamber as claimed in claim 1 in which said air tubes are cylindrical and are bell-mouthed at their inlet, that is the outer, ends.

* * * * *

UNITED STATES PATENT AND TRADEMARK OFFICE

CERTIFICATE OF CORRECTION

PATENT NO. : 4,301,657

DATED : November 24, 1981

INVENTOR(S) : Robert N. Penny

It is certified that error appears in the above—identified patent and that said Letters Patent is hereby corrected as shown below:

Column 3, lines 6 and 7, delete "FIG. 6 is a cross-section on the plane VI-VI in FIG. 5."

Column 3, line 3, insert -- FIG. 6 is a cross-section on the plane VI-VI in FIG. 5 . --.

Signed and Sealed this

Ninth Day of March 1982

[SEAL]

*Attest:*

GERALD J. MOSSINGHOFF

*Attesting Officer*

*Commissioner of Patents and Trademarks*